US005802873A

United States Patent [19]

Howard

[11] Patent Number: 5,802,873

[45] Date of Patent: Sep. 8, 1998

[54] CRYOGENIC RECTIFICATION SYSTEM WITH DUAL FEED AIR TURBOEXPANSION

[75] Inventor: Henry Edward Howard, Grand Island, N.Y.

[73] Assignee: Praxair Technology, Inc., Danbury, Conn.

[21] Appl. No.: 848,397

[22] Filed: May 8, 1997

[51] Int. Cl.[6] ..... F25J 3/00

[52] U.S. Cl. ..... 62/646; 62/939

[58] Field of Search ..... 62/646, 939

[56] References Cited

U.S. PATENT DOCUMENTS

| | | | |
|---|---|---|---|
| 4,152,130 | 5/1979 | Theobald | 62/18 |
| 4,555,256 | 11/1985 | Skolaude et al. | 62/18 |
| 5,108,476 | 4/1992 | Dray et al. | 62/24 |
| 5,123,249 | 6/1992 | Buttle | 62/24 |
| 5,157,926 | 10/1992 | Guilleminot | 62/24 |
| 5,251,450 | 10/1993 | Agrawal et al. | 62/939 |
| 5,263,328 | 11/1993 | Rohde | 62/646 |
| 5,275,003 | 1/1994 | Agrawal et al. | 62/24 |
| 5,287,704 | 2/1994 | Rathbone | 62/25 |
| 5,329,776 | 7/1994 | Grenier | 62/24 |
| 5,400,600 | 3/1995 | Grenier | 62/25 |
| 5,412,953 | 5/1995 | Darredeau et al. | 62/25 |
| 5,437,161 | 8/1995 | Cretien | 62/646 |
| 5,454,226 | 10/1995 | Darredeau et al. | 62/9 |
| 5,475,980 | 12/1995 | Grenier et al. | 62/939 |

*Primary Examiner*—Ronald C. Capossela
*Attorney, Agent, or Firm*—Stanley Ktorides

[57] ABSTRACT

A cryogenic rectification system wherein feed air is turboexpanded to generate refrigeration through two turboexpanders operating at the same inlet pressure but at different inlet temperatures enabling the turboexpanders to efficiently drive the compressor or compressors which compress the feed air to the single expansion pressure.

8 Claims, 2 Drawing Sheets

CRYOGENIC RECTIFICATION SYSTEM WITH DUAL FEED AIR TURBOEXPANSION

TECHNICAL FIELD

This invention relates generally to cryogenic rectification and is particularly useful in cryogenic air separation systems wherein liquid is withdrawn from the cryogenic air separation plant for recovery.

BACKGROUND ART

Oxygen is produced commercially in large quantities by the cryogenic rectification of feed air in a cryogenic air separation plant. At times it may be desirable to produce oxygen at a higher pressure. While gaseous oxygen may be withdrawn from the cryogenic air separation plant and compressed to the desired pressure, it is generally preferable for capital cost purposes to withdraw oxygen as liquid from the cryogenic air separation plant, increase its pressure, and then vaporize the pressurized liquid oxygen to produce the desired elevated pressure product oxygen gas.

The withdrawal of the oxygen as liquid from the cryogenic air separation plant removes a significant amount of refrigeration from the plant necessitating significant reintroduction of refrigeration into the plant. This is even more the case when, in addition to the high pressure oxygen gas, it is desired to recover liquid product, e.g. liquid oxygen and/or liquid nitrogen, from the plant.

One very effective way to provide refrigeration into a cryogenic air separation plant is to turboexpand a compressed gas stream and to pass that stream, or at least the refrigeration generated thereby, into the plant. In situations where significant amounts of liquid are withdrawn from the plant, more than one such turboexpander is often employed. However, it is difficult to employ multiple turboexpanders without operating inefficiently especially if all the turboexpanded streams are feed air streams.

Accordingly, it is an object of this invention to provide an improved system for the cryogenic rectification of feed air employing more than one turboexpander wherein all of the turboexpanded streams are feed air streams.

SUMMARY OF THE INVENTION

The above and other objects, which will become apparent to one skilled in the art upon a reading of this disclosure, are attained by the present invention, one aspect of which is:

A method for the cryogenic separation of air comprising:

(A) compressing feed air to an expansion pressure to produce expansion pressure feed air;

(B) cooling a first portion of the expansion pressure feed air to a first temperature, turboexpanding the cooled first portion, and passing the turboexpanded first portion into a cryogenic air separation plant;

(C) cooling a second portion of the expansion pressure feed air to a second temperature which is lower than said first temperature, turboexpanding the cooled second portion, and passing the turboexpanded second portion into the cryogenic air separation plant wherein shaft work from the expansion of the first portion and the second portion of the feed air is used to compress the feed air to the expansion pressure;

(D) separating the feed air by cryogenic rectification within the cryogenic air separation plant to produce product; and (E) recovering product from the cryogenic air separation plant.

Another aspect of the invention is:

Apparatus for the cryogenic separation of air comprising:

(A) at least one feed air booster compressor for compressing feed air to an expansion pressure, and means for providing feed air to said feed air booster compressor(s);

(B) a main heat exchanger, a first turboexpander, and means for passing feed air from the feed air booster compressor(s) through a first portion of the main heat exchanger and then to the first turboexpander;

(C) a second turboexpander, and means for passing feed air from the feed air booster compressor(s) through a second portion of the main heat exchanger and then to the second turboexpander wherein the first and second turboexpanders directly drive the feed air booster compressor(s);

(D) a cryogenic air separation plant, and means for passing feed air from the first turboexpander and from the second turboexpander into the cryogenic air separation plant; and (E) means for recovering product from the cryogenic air separation plant.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "feed air" means a mixture comprising primarily oxygen, nitrogen and argon, such as ambient air.

As used herein, the terms "upper portion" and "lower portion" of a column mean those sections of the column respectively above and below the mid point of the column.

As used herein, the terms "turboexpansion" and "turboexpander" mean respectively method and apparatus for the flow of high pressure gas through a turbine to reduce the pressure and the temperature of the gas, thereby generating refrigeration.

As used herein the term "compressor" means a machine that increases the pressure of a gas by the application of work.

As used herein, the term "cryogenic air separation plant" means a facility for fractionally distilling feed air, comprising one or more columns and the piping, valving and heat exchange equipment attendant thereto.

As used herein, the term "booster compressor" means a compressor which provides additional compression for purposes of attaining higher air pressures required for the vaporization of liquid oxygen and/or process turboexpansion(s) in conjunction with a cryogenic air separation plant.

The numerals in the Figures are the same for the common elements.

DETAILED DESCRIPTION

In the practice of this invention, feed air is compressed to a desired expansion pressure and then cooled in two portions to two different temperatures. The two portions are then separately turboexpanded and fed into a cryogenic air separation plant. The turboexpanders are directly coupled to and directly drive the booster compressor system. The turboexpansion system which operates between the same pressure limits but at different turboexpander inlet temperatures enables the turbomachinery to operate efficiently.

The use of the turboexpansion shaft work to power the booster compressor(s) to generate a common expansion pressure provides a two-fold advantage. If the shaft work of the turboexpanders were generator loaded, a significant energy loss would be realized. Moreover, by producing a single boosted feed air pressure by the work of both turboexpanders, the heat exchanger design may be made with greater simplification and with reduced costs.

Figure 1:
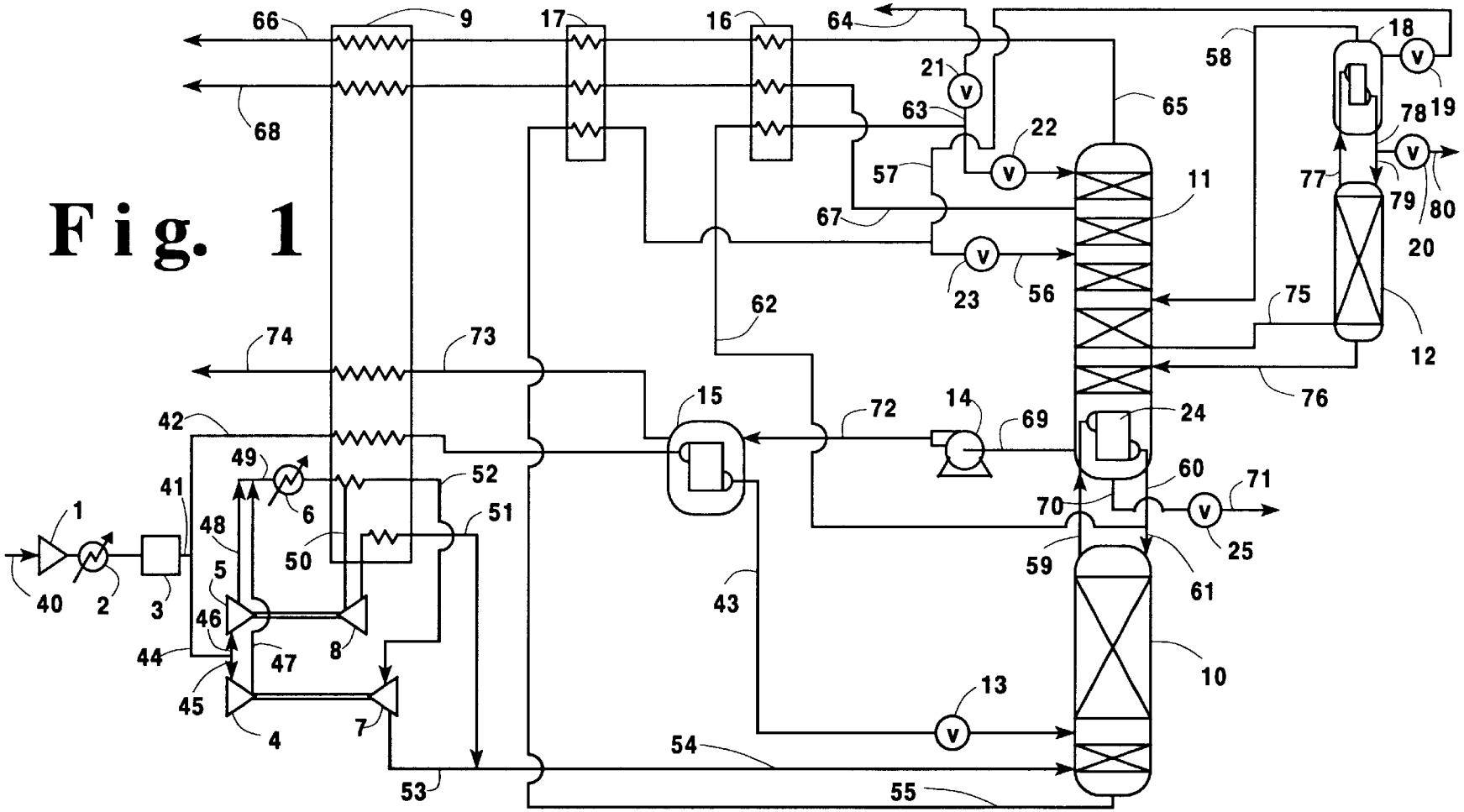
FIG. 1 is a schematic representation of one preferred embodiment of the invention wherein two feed air booster compressors are employed.

The invention will be described in greater detail with reference to the Drawings. Referring now to FIG. 1, feed air 40 is compressed by passage through base load air compressor 1 to a pressure generally within the range of from 70 to 200 pounds per square inch absolute (psia), cooled of heat of compression by passage through cooler 2, and cleaned of high boiling impurities such as carbon dioxide, water vapor and hydrocarbons by passage through prepurifier 3. Resulting prepurified feed air 41 may be passed to the feed air booster compressor system for compression to the expansion pressure. In the embodiment of the invention illustrated in FIG. 1, a portion 42 of the prepurified feed air is not passed on to the feed air booster compressor system. Rather prepurified feed air portion 42 is cooled by passage through main heat exchanger 9 and then passed into product boiler 15 wherein it is condensed by indirect heat exchange with boiling oxygen-rich liquid. Resulting liquefied air 43 is passed through valve 13 and into a cryogenic air separation plant. Instead of passage through valve 13, the air may be passed through a dense phase, that is supercritical fluid or liquid, turbo machine to recover the pressure energy. Typically the recovered shaft work will drive an electrical generator. In the embodiments of the invention illustrated in the Drawings, the cryogenic air separation plant comprises three columns including a double column comprising a first or higher pressure column 10 and a second or lower pressure column 11, and an argon sidearm column 12. Liquefied feed air stream 43 is passed into higher pressure column 10.

Another portion 44 of purified feed air 41 is passed into the feed air booster compressor system, which in the embodiment of the invention illustrated in FIG. 1 comprises two booster compressors enumerated 4 and 5. Typically stream 44 is about equally divided between booster compressors 4 and 5 with stream 45 comprising from 30 to 70 percent of stream 44 being passed into booster compressor 4, and stream 46 comprising from 70 to 30 percent of stream 44 being passed into booster compressor 5. Within the booster compressors the feed air is compressed to the expansion pressure which is within the range of from 150 to 500 psia. In the embodiment of the invention illustrated in FIG. 1, expansion pressure feed air stream 47 which exits feed air booster compressor 4 is combined with expansion pressure feed air stream 48 which exits feed air booster compressor 5 to form expansion pressure feed air stream 49 which is cooled of heat of compression by passage through cooler 6 and then passed into main heat exchanger 9.

First portion 50 of the expansion pressure feed air, having passed through a first portion of main heat exchanger 9 and having been cooled to a first temperature generally within the range of from 280 to 150 K, is passed to first turboexpander 8 wherein it is turboexpanded to a pressure within the range of from 70 to 85 psia. Resulting turboexpanded first portion 51 is further cooled in main heat exchanger 9 and then passed into the lower portion of higher pressure column 10.

Second portion 52 of the expansion pressure feed air, having passed through a second portion of main heat exchanger 9 and having been cooled to a second temperature which is less than the first temperature and generally with the range of from 150 to 110 K, is passed to second turboexpander 7 wherein it is turboexpanded to a pressure within the range of from 70 to 85 psia. Resulting turboexpanded second portion 53 is then passed into the lower portion of higher pressure column 10. Preferably, as illustrated in the Drawings, the turboexpanded first and second feed air portions 51 and 53 are combined to form turboexpanded feed air stream 54 which is passed into the lower portion of higher pressure column 10. Preferably the second temperature will be at least 80 K less than the first temperature.

Figure 2:
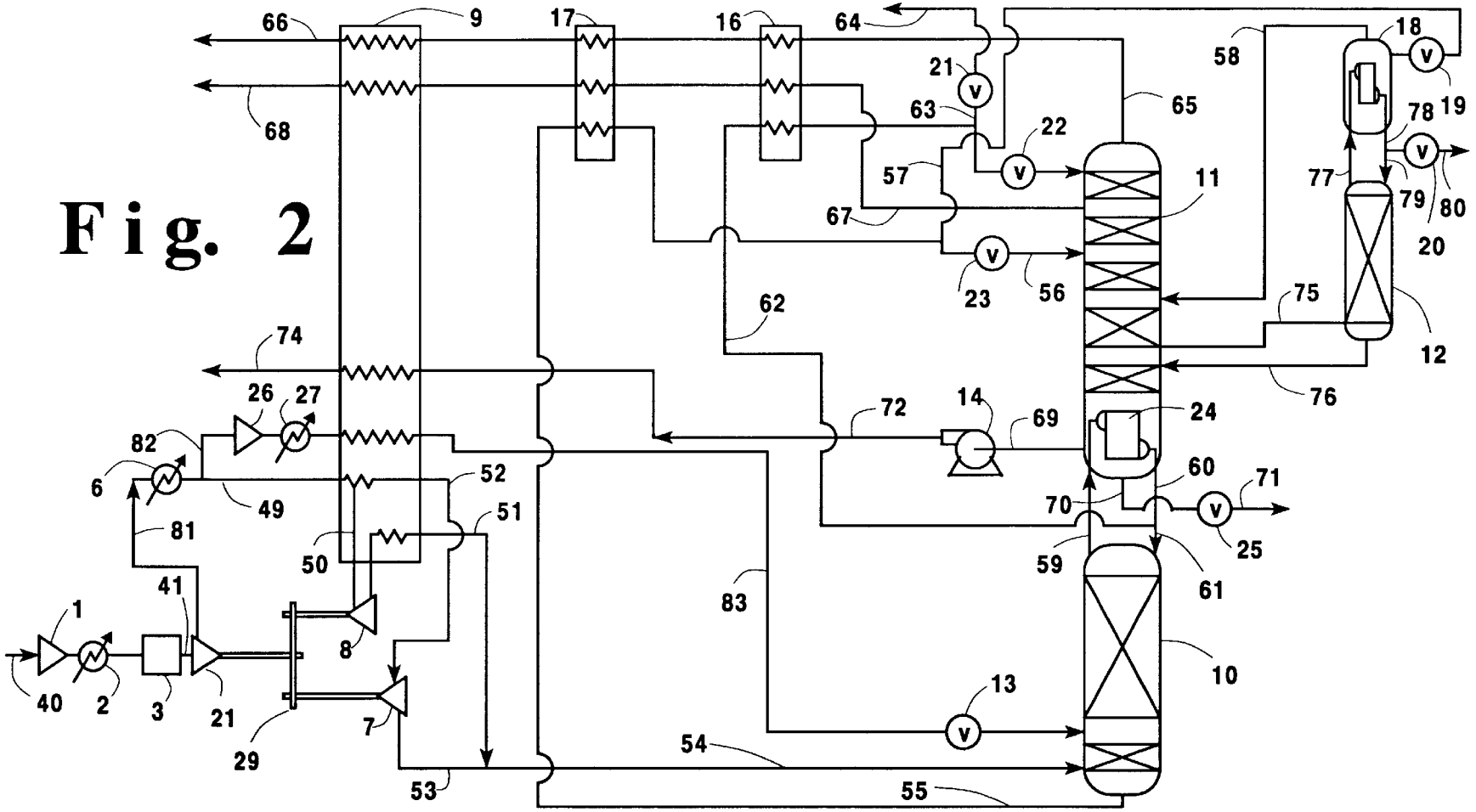
FIG. 2 is a schematic representation of another preferred embodiment of the invention wherein one feed air booster compressor is employed.

The first and second turboexpanders are directly coupled, either through two separate shafts such as is illustrated in FIG. 1, or through a geared arrangement such as is illustrated in FIG. 2, to the feed air booster compressor system so as to drive the feed air booster compressor(s). In the embodiment of the invention illustrated in FIG. 1, turboexpander 8 is directly coupled to and drives feed air booster compressor 5, and turboexpander 7 is directly coupled to and drives feed air booster compressor 4. In the embodiment of the invention illustrated in FIG. 2 both turboexpanders 8 and 7 are directly coupled to and drive single feed air booster compressor 21 by means of geared system 29.

Higher pressure column 10 is operating at a pressure within the range of from 70 to 85 psia. Within higher pressure column 10, the feed air fed into column 10 is separated by cryogenic rectification into nitrogen-enriched vapor and oxygen-enriched liquid. Oxygen-enriched liquid is withdrawn from the lower portion of higher pressure column 10 as stream 55, subcooled by passage through subcooler 17, and the majority passed through valve 23 and into lower pressure column 11 as stream 56. A portion 57 of the subcooled oxygen-enriched liquid is passed through valve 19 and into argon column top condenser 18 wherein it is essentially completely vaporized by indirect heat exchange with condensing argon column top vapor. Resulting oxygen-enriched vapor 58 is passed from top condenser 18 into lower pressure column 11.

Nitrogen-enriched vapor is withdrawn from higher pressure column 10 as stream 59 and passed into main condenser 24 wherein it is condensed by indirect heat exchange with boiling lower pressure column 11 bottom liquid. Resulting nitrogen-enriched liquid 60 is withdrawn from main condenser 24, a first portion 61 is returned to higher pressure column 10 as reflux, and a second portion 62 is subcooled by passage through subcooler 16, and passed through valve 22, into lower pressure column 11. If desired, a portion of the nitrogen-enriched liquid may be recovered as product liquid nitrogen having a nitrogen concentration of at least 99.99 mole percent. In the embodiment of the invention illustrated in FIG. 1, a portion 63 of nitrogen-enriched liquid 62 is passed through valve 21 and recovered as liquid nitrogen product 64.

Lower pressure column 11 is operating at a pressure less than that of higher pressure column 10 and generally within the range of from 15 to 20 psia. Within lower pressure column 11 the various feeds are separated by cryogenic rectification into nitrogen-rich vapor and oxygen-rich liquid. Nitrogen-rich vapor is withdrawn from the upper portion of lower pressure column 11 as stream 65, warmed by passage through heat exchangers 16, 17 and 9 and removed from the system as stream 66 which may be recovered as product nitrogen gas having a nitrogen concentration of at least 99 mole percent. For product purity control purposes, a nitrogen containing stream 67 is withdrawn from lower pressure column 11 below the level from which stream 65 is withdrawn. Stream 67 is warmed by passage through heat exchangers 16, 17 and 9 and withdrawn from the system as stream 68.

Oxygen-rich liquid, i.e. liquid oxygen having an oxygen concentration of at least 99.5 mole percent, is withdrawn from the lower portion of lower pressure column 11 as liquid oxygen stream 69 increased in pressure, vaporized, and recovered. If desired a portion of the oxygen-rich liquid may be recovered as product liquid oxygen, such as in the embodiment illustrated in FIG. 1 wherein stream 70 is withdrawn from column 11, passed through valve 25 and recovered as liquid oxygen stream 71. In the embodiment illustrated in FIG. 1, stream 69 is passed to liquid pump 14 wherein it is pumped to a pressure within the range of from 25 to 100 psia. Resulting pressurized liquid oxygen stream 72 is passed to product boiler 15 wherein it is vaporized by indirect heat exchange with the aforesaid condensing feed air. Resulting gaseous oxygen is withdrawn from product boiler 15 as stream 73, passed through main heat exchanger 17, and recovered as product gaseous oxygen 74 having an oxygen concentration of at least 99.5 mole percent.

An argon-containing stream 75 is passed from lower pressure column 11 into argon sidearm column 12 wherein it is separated by cryogenic rectification into argon-richer vapor and oxygen-richer liquid. Oxygen-richer liquid is returned to lower pressure column 11 in stream 76. Argon-richer vapor 77 is passed into top condenser 18 wherein it is condensed by indirect heat exchange with the aforesaid vaporizing oxygen-enriched liquid. A portion of resulting argon-richer liquid 78 is returned to argon column 12 as reflux stream 79, and another portion is passed through valve 20 and recovered as argon product 80 having an argon concentration generally within the range of from 95 to 99.5 mole percent.

FIG. 2 illustrates another embodiment of the invention. The elements of the embodiment illustrated in FIG. 2 which are common with those of the embodiment illustrated in FIG. 1 will not be discussed again in detail.

Referring now to FIG. 2, all of prepurified feed air stream is passed to single feed air booster compressor 21 wherein the feed air is compressed to the expansion pressure. The resulting expansion pressure feed air 81 is cooled by passage through cooler 6. A portion 82 is further compressed by passage through compressor 26, cooled of heat of compression by passage through cooler 27, and liquefied by passage through main heat exchanger 9 by indirect heat exchange with vaporizing oxygen-rich liquid. In the embodiment of the invention illustrated in FIG. 2, the pressurized oxygen-rich liquid 72 is passed directly into main heat exchanger 9 for vaporization, i.e. a product boiler is not employed. The resulting liquefied feed air 83 is passed through valve 13 and into higher pressure column 10. Instead of passage through valve 13, feed air 83 may be passed through a dense phase turbo machine to recover the pressure energy and typically the recovered shaft work will drive an electrical generator. The remaining portion of the expansion pressure feed air is designated stream 49 and is further processed as described in accordance with the embodiment illustrated in FIG. 1.

Although the invention has been described in detail with reference to certain preferred embodiments, those skilled in the art will recognize that there are other embodiments of the invention within the spirit and the scope of the claims. For example, the cryogenic air separation plant may comprise fewer or more than three columns such as where the cryogenic air separation plant comprises a single column, or a double column without an argon sidearm column.

I claim:

1. A method for the cryogenic separation of air comprising:

(A) compressing feed air to an expansion pressure to produce expansion pressure feed air;

(B) cooling a first portion of the expansion pressure feed air to a first temperature, turboexpanding the cooled first portion, and passing the turboexpanded first portion into a cryogenic air separation plant;

(C) cooling a second portion of the expansion pressure feed air to a second temperature which is lower than said first temperature, turboexpanding the cooled second portion, and passing the turboexpanded second portion into the cryogenic air separation plant wherein shaft work from the expansion of the first portion and the second portion of the feed air is used to compress the feed air to the expansion pressure;

(D) separating the feed air by cryogenic rectification within the cryogenic air separation plant to produce product; and (E) recovering product from the cryogenic air separation plant.

2. The method of claim 1 wherein product is warmed by indirect heat exchange with at least one of the cooling first portion and the cooling second portion of the expansion pressure feed air prior to recovery.

3. The method of claim 1 wherein the second temperature is at least 80 K less than the first temperature.

4. The method of claim 1 wherein the cryogenic air separation plant comprises a double column having a higher pressure column and a lower pressure column, and wherein both the turboexpanded first portion and the turboexpanded second portion are passed into the higher pressure column.

5. Apparatus for the cryogenic separation of air comprising:

(A) at least one feed air booster compressor for compressing feed air to an expansion pressure, and means for providing feed air to said feed air booster compressor (s);

(B) a main heat exchanger, a first turboexpander, and means for passing feed air from the feed air booster compressor(s) through a first portion of the main heat exchanger and then to the first turboexpander;

(C) a second turboexpander, and means for passing feed air from the feed air booster compressor(s) through a second portion of the main heat exchanger and then to the second turboexpander wherein the first and second turboexpanders directly drive the feed air booster compressor(s);

(D) a cryogenic air separation plant, and means for passing feed air from the first turboexpander and from the second turboexpander into the cryogenic air separation plant; and (E) means for recovering product from the cryogenic air separation plant.

6. The apparatus of claim 5 having only one feed air booster compressor.

7. The apparatus of claim 5 having two feed air booster compressors.

8. The apparatus of claim 5 wherein the cryogenic air separation plant comprises a double column having a higher pressure column and a lower pressure column, wherein the means for passing feed air from the first turboexpander into the cryogenic air separation plant and the means for passing feed air from the second turboexpander into the cryogenic air separation plant both communicate with the higher pressure column.

* * * * *